US005896618A

United States Patent [19]

Woo et al.

[11] Patent Number: 5,896,618

[45] Date of Patent: Apr. 27, 1999

[54] VACUUM CLEANER

[75] Inventors: Han-Jin Woo; Jeong-Gon Song; Sung-Lo Cho, all of Kwangju, Rep. of Korea

[73] Assignee: Kwangju Electronics Co., Ltd., Kwangju, Rep. of Korea

[21] Appl. No.: 08/843,220

[22] Filed: Apr. 14, 1997

[30] Foreign Application Priority Data

| | | | |
|---|---|---|---|
| Apr. 13, 1996 | [KR] | Rep. of Korea | 96-11194 |
| Apr. 13, 1996 | [KR] | Rep. of Korea | 96-11195 |
| Apr. 13, 1996 | [KR] | Rep. of Korea | 96-11196 |
| May 28, 1996 | [KR] | Rep. of Korea | 96-18279 |

[51] Int. Cl.[6] ..... A47L 9/30

[52] U.S. Cl. ..... 15/324; 15/377; 362/91

[58] Field of Search ..... 15/324, 377; 362/91

[56] References Cited

U.S. PATENT DOCUMENTS

| | | | |
|---|---|---|---|
| 1,996,934 | 4/1935 | Siedle | 15/324 X |
| 2,132,007 | 10/1938 | Smith | 15/324 X |
| 2,575,554 | 11/1951 | Langille | 15/324 X |
| 2,604,578 | 7/1952 | Sutton | 15/324 X |
| 2,632,913 | 3/1953 | Swann | 15/324 |
| 2,637,062 | 5/1953 | Sutton et al. | 15/324 |
| 2,649,607 | 8/1953 | Vance | 15/324 |
| 2,769,997 | 11/1956 | Sheahan | 15/324 |
| 3,679,885 | 7/1972 | Selley et al. . | |
| 4,757,574 | 7/1988 | Sumerau | 15/324 |
| 5,107,565 | 4/1992 | Chun | 15/324 |
| 5,207,498 | 5/1993 | Lawrence et al. | 15/324 X |

FOREIGN PATENT DOCUMENTS

| | | |
|---|---|---|
| GM 16 99 440 | 3/1955 | Germany . |
| 24 45 437 B2 | 6/1979 | Germany . |
| 80 12 221 U1 | 9/1980 | Sweden . |

*Primary Examiner*—Chris K. Moore
*Attorney, Agent, or Firm*—Staas & Halsey

[57] ABSTRACT

A vacuum cleaner, which has a cleaning attachment through which dirt and dust are drawn, includes a lighting device that illuminates a surface to be cleaned. The lighting device includes a bulb in a groove that is formed at the cleaning attachment's front, thus horizontally illuminating the surface. Preferably, the bulb is a halogen lamp which is of predetermined length. The groove includes a plurality of air holes so that outside air can flow into the groove. A filter is provided in the air holes to prevent dust and dirt from getting into the groove. The lighting device may be detachably mounted on the cleaning attachment, and includes a case and a bulb installed in the case for illumination. The case includes a plurality of locking pieces that securely fit into a slit formed on the cleaning attachment so that the lighting device is connected to the cleaning attachment.

5 Claims, 7 Drawing Sheets

VACUUM CLEANER

BACKGROUND OF THE INVENTION (1) Field of the Invention

The present invention generally relates to a vacuum cleaner. More particularly, it relates to a cleaning attachment for a vacuum cleaner through which dust and loose dirt from rugs and other surfaces are first drawn during operation.

(2) Description of the Related Art

A conventional vacuum cleaner cleans floors and floor coverings by drawing up the dirt from them using a vacuum created by a difference between the pressure of the cleaner's interior and atmospheric pressure. FIG. 7 depicts the overall construction of such a conventional vacuum cleaner.

The vacuum cleaner, as shown in FIG. 7, is comprised of a main body 10 equipped with a driving means (not illustrated) and a dust collecting means (not illustrated), a cleaning attachment 30 that draws up dirt and dust by using the vacuum generated by the main body 10, and an extension pipe 20 and connecting hose 22 is for connecting the cleaning attachment 30 with the main body 10. The connecting hose 22 connected to the main body 10 and one end of a connecting joint 21, which has a handle 23. The other end of the connecting joint 21 is connected to the extension pipe 20, and the extension pipe 20 is linked with the cleaning attachment 30. This arrangement allows the cleaning attachment 30 to communicate with the main body 10. Reference numeral 24 denotes a control portion.

The main body 10 produces a vacuum by the operation of a motor (not illustrated), and driving means, and includes a dust collecting bag, which is the dust collecting means (not illustrated). The connecting joint 21 and the flexible connecting hose 22 are passages through which dust and dirt are drawn into the vacuum cleaner. The cleaning attachment 30 includes a suction hole 31 and a suction path 32 that communicates with the bottom of the extension pipe 20, through which the dirt is drawn into the main body 10 along with air. Reference numeral 33 designates a roller that enables the cleaning attachment 30 to move more easily.

Once a user turns on the conventional vacuum cleaner by the use of the control portion 24 located on the handle 23, the motor (not illustrated) of the main body 10 goes into action to create a vacuum. Thus, as the air is drawn into the main body 10 at high speeds sequentially through the cleaning attachment 30, the extension pipe 20, the connecting joint 21 and the connecting hose 22, the dirt and dust on surfaces to be cleaned are drawn into the main body's 10 dust collecting bag.

A user cleans floors and floor coverings with this conventional vacuum cleaner, moving the cleaning attachment 30 to spots where there are a lot of dust and dirt. When he or she is cleaning a dimly-lit area of the floor, however, he or she cannot adequately inspect the progress of the cleaning, this usually results in more vacuuming in the aforementioned areas than necessary, thereby increasing the time needed for the task and power consumption.

SUMMARY OF THE INVENTION

The present invention concerns a vacuum cleaner that can obviate the aforementioned problems and disadvantages of the conventional art.

It is the objective of the present invention to provide a vacuum cleaner with a cleaning attachment that has a lighting device for illuminating a surface to be cleaned, whereby a user can easily find dust particles on the surface and clean even a dimly-lit spot perfectly.

In order to obtain the aforementioned objective of the present invention, there is disclosed a vacuum cleaner equipped with a cleaning attachment having a suction path through which dirt and dust are drawn by a vacuum generated by the vacuum cleaner's main body. The vacuum cleaner further includes a lighting device for illuminating a surface to be cleaned.

The lighting device includes a bulb set in a groove that is formed in the cleaning attachment's front, thus horizontally illuminating the surface. Preferably, the bulb is a halogen bulb which is of predetermined length. A transparent window is formed on the opened fore part of the groove. A means of cooling off the bulb mounted on the cleaning attachment includes a plurality of heat-emitting holes so that the groove is in communication with the suction path. The groove includes a plurality of air holes so that outside air can flow into the groove. A filter is provided in the air holes to prevent dust and dirt from getting into the groove.

The lighting device may alternatively be detachably mounted on the cleaning attachment, and include a case and a bulb installed in the case for illumination. The case includes a plurality of locking pieces that securely fit into a slit formed on the cleaning attachment so that the lighting device is connected to the cleaning attachment.

DETAILED DESCRIPTION OF THE PREFERRED EMBODIMENTS

The preferred embodiments of the present invention will be described in detail with reference to the accompanying drawings.

Figure 1:
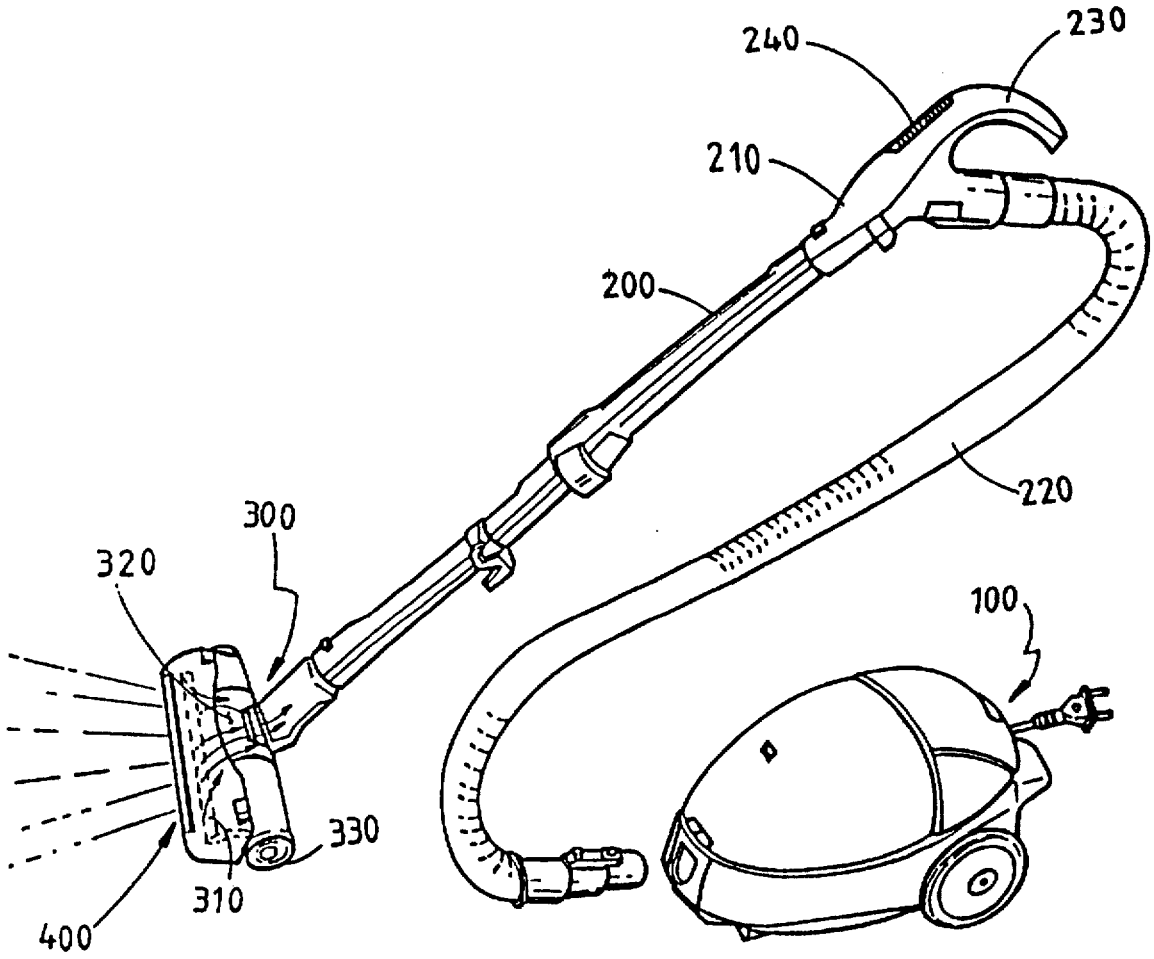
FIG. 1 depicts the overall construction of a vacuum cleaner in accordance with the present invention.
Figure 2:
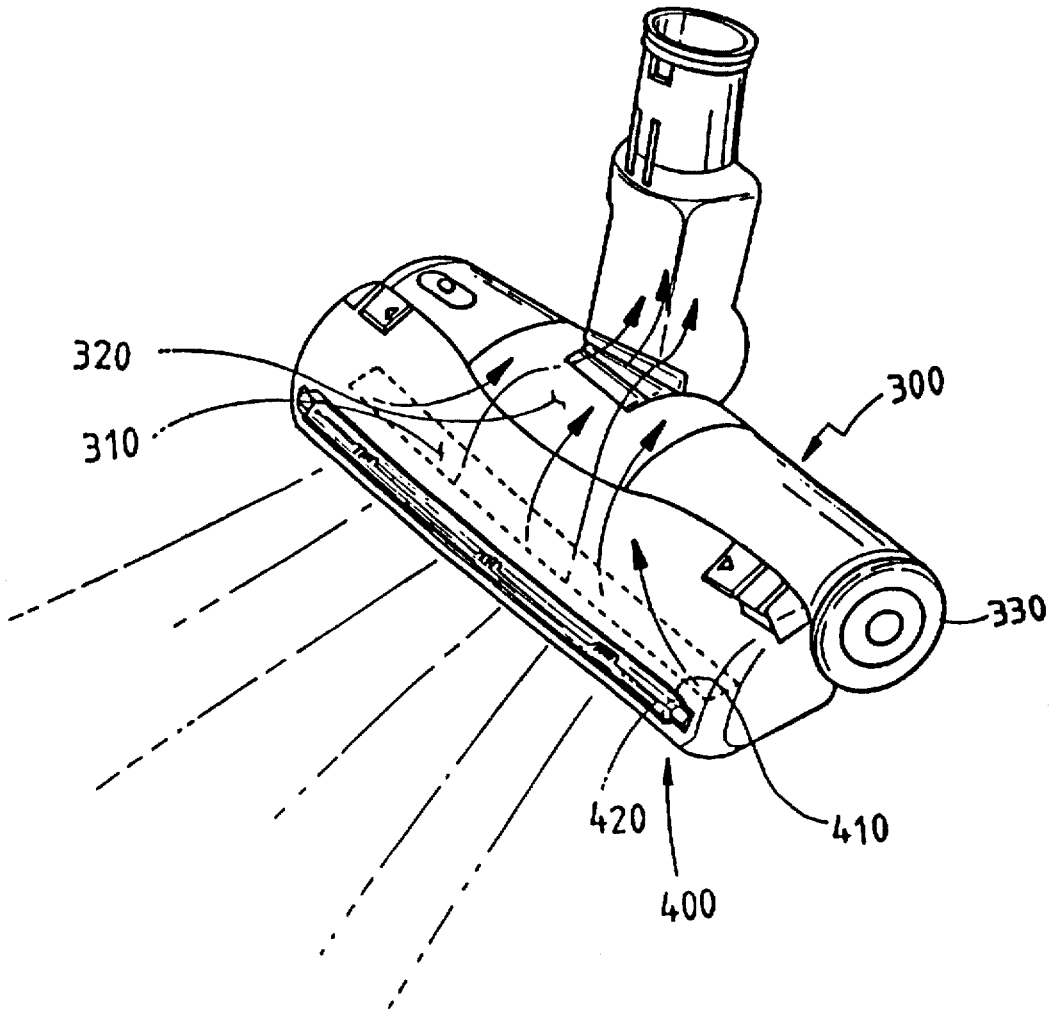
FIG. 2 is an enlarged-perspective view of a cleaning attachment for a vacuum cleaner in accordance with the first preferred embodiment of the present invention.
Figure 3:
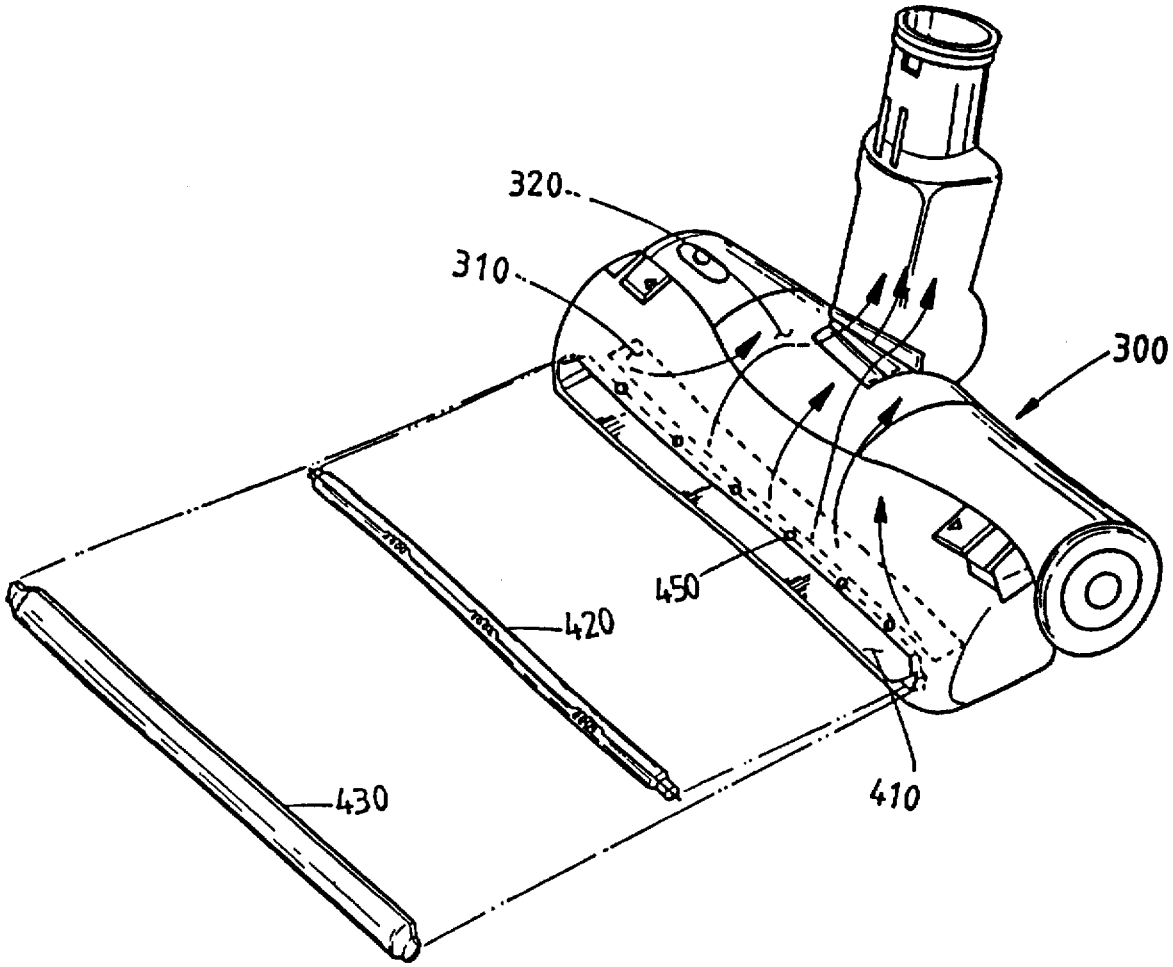
FIG. 3 is an exploded-perspective view of a lighting device in accordance with the first preferred embodiment of the present invention.
Figure 4:
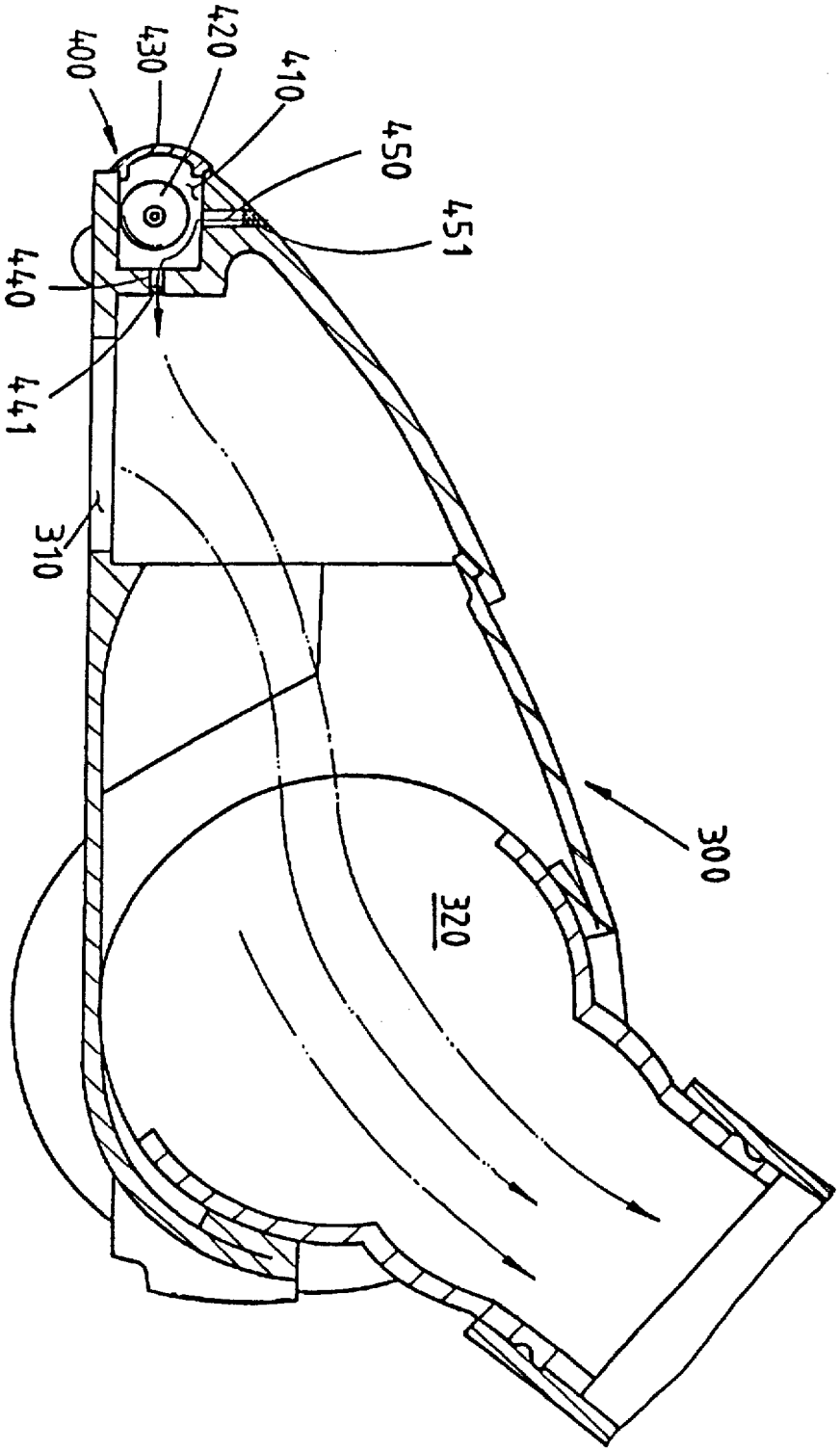
FIG. 4 is a cross-sectional view of the cleaning attachment with the lighting device in accordance with the present invention.

A vacuum cleaner of the present invention, as shown in FIG. 1, is comprised of a main body 100 equipped with a driving means (not illustrated) that produces a vacuum, a dust collecting means (not illustrated) which collects inhaled dust and dirt, and a cleaning attachment 300 that has a suction hole 310 formed at its bottom and a suction path 320 formed inside the cleaning attachment 300. The cleaning attachment 300 communicates with the main body 100 through an extension pipe 200, a connecting joint 210 which includes a handle 230, and a connecting hose 220. Reference numerals 240 and 330, respectively denote a control portion that is used to manipulate the vacuum cleaner, and a roller which allows the cleaning attachment 300 to move more easily. On the front portion of the cleaning attachment 300 is a horizontally-oriented lighting device 400, the present invention's feature, that illuminates the area in front of the cleaning attachment 300. Referring to FIGS. 2 to 4, the inventive lighting device 400 is now described in detail.

At the lower edge of the cleaning attachment's 300 front is a groove 410 formed extending lengthwise, which is designed to be as wide as the suction hole 310. A bulb 420, which is of predetermined length, is installed inside the groove. It is preferable that a reflective halogen lamp is used as the bulb 420.

A transparent window 430, which is installed on the groove 410 to cover the bulb 420, provides protection for the bulb 420 against outside shock, and prevents dirt and dust from getting into the groove 410. The placement of the bulb 420 in this manner allows for the area of the floor directly in front of the cleaning attachment 300 to be adequately illuminated so that a user can see dust particles on the floor very well.

If the bulb 420 remains on for long periods of time, it can overheat, which decreases its life span. Therefore, air holes 450 and heat-emitting holes 440 are formed on the cleaning attachment 300 to cool the bulb 420. More specifically, the plurality of air holes 450 allow the groove 410 to being communication with outside and the plurality of heat-emitting holes 440 allow the groove 410 to be in communication with the suction path 320, thereby cooling the bulb 420.

Referring to FIG. 4, filters 441 and 451 are respectively installed on the heat-emitting holes 440 and the air holes 450 in order to prevent dust from getting into the groove 410. The vacuum produced by the main body 100 during operation causes dust and dirt to be drawn into the vacuum cleaner through the suction hole 310 and suction path 320. Since the heat-emitting holes 440 are in communication with the suction path 320, the outside air flows into the groove 410 through the air holes 450, and enters the suction path 320 by way of the heat-emitting holes 440. In this manner, the outside air flows through the groove 410, thereby cooling the bulb 420, but dirt and dust are blocked by the filters 441,451.

The following description relates to the operation of the vacuum cleaner of the present invention.

Once the user manipulates the control portion 240 on the handle 230, the motor (not illustrated) of the main body 100 operates to produce a vacuum. The user then performs vacuum cleaning, holding the extension pipe 200 and the handle 230 and moving the cleaning attachment 300 to surfaces where there are dust particles so that the vacuum cleaner draws up them through the suction hole 310.

At this point, the bulb 420 illuminates the area in front of the cleaning attachment 300 so that the user may adequately monitor the progress of cleaning. In other words, since the bulb 420 throws light on the floor nearly horizontally, the shadow of a dust particle is created on the floor in the direction of light, thereby allowing them to be easily located.

Thus, the user is able to clean the area of the floor where there are a lot of dust particles in a short period of time. When the dust particles' shadow are no longer visible, the user can then surmise complete and thorough cleaning and discontinue vacuuming that area. This increases vacuuming efficiency by preventing the need for the user to possibly overcompensate for the lack of illumination provided by the prior art by continuing to vacuum after the floor, unbeknown to him, is clean.

If the vacuum cleaner is used for a long period of time, the bulb 420 is prevented from overheating by the cooling action of the air flowing through the air holes 450 and the heat-emitting holes 440. Dust and dirt are drawn into the vacuum cleaner along with the air through the air holes 450 by the vacuum generated by the main body 100. This vacuum allows the outside air to be sequentially drawn through the air holes 450, over the bulb 420, and through the heat-emitting holes 440 to the suction path 320. Dirt and dust, which would decrease the illumination of the bulb 420, are prevented from entering the groove by the filter 451.

Figure 5:
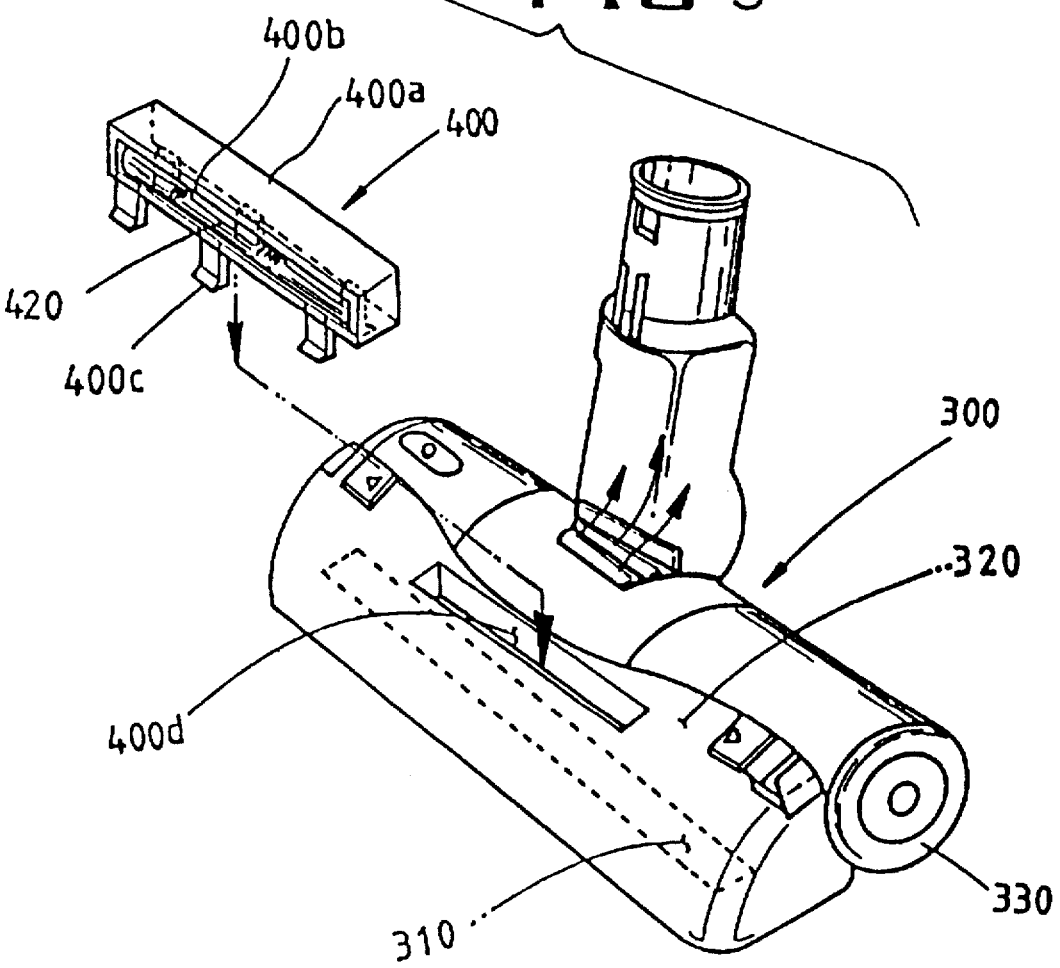
FIG. 5 depicts a cleaning attachment for a vacuum cleaner in accordance with the second preferred embodiment of the present invention.
Figure 6:
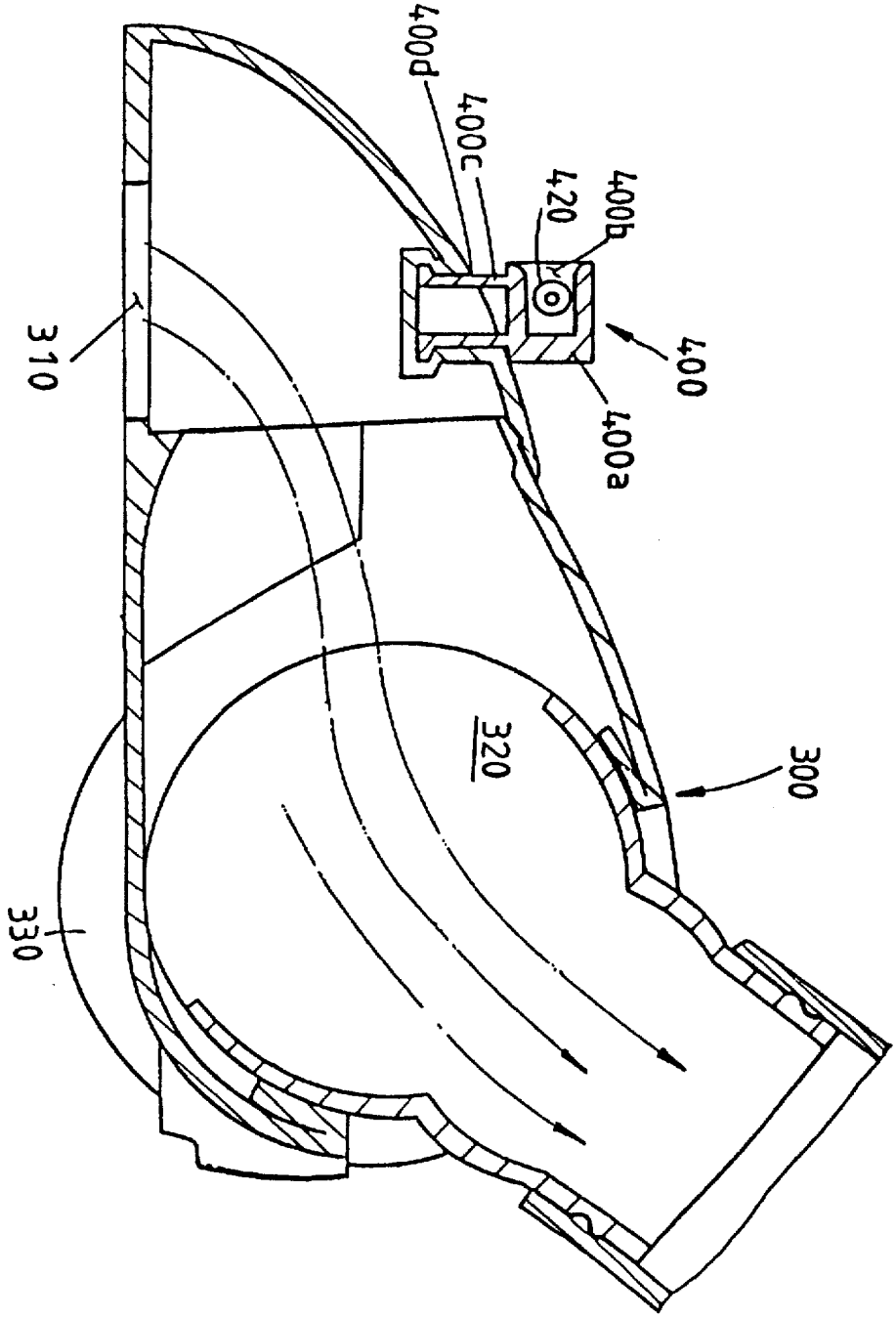
FIG. 6 is a cross-sectional view of a lighting device in accordance with the first preferred embodiment of the present invention.
Figure 7:
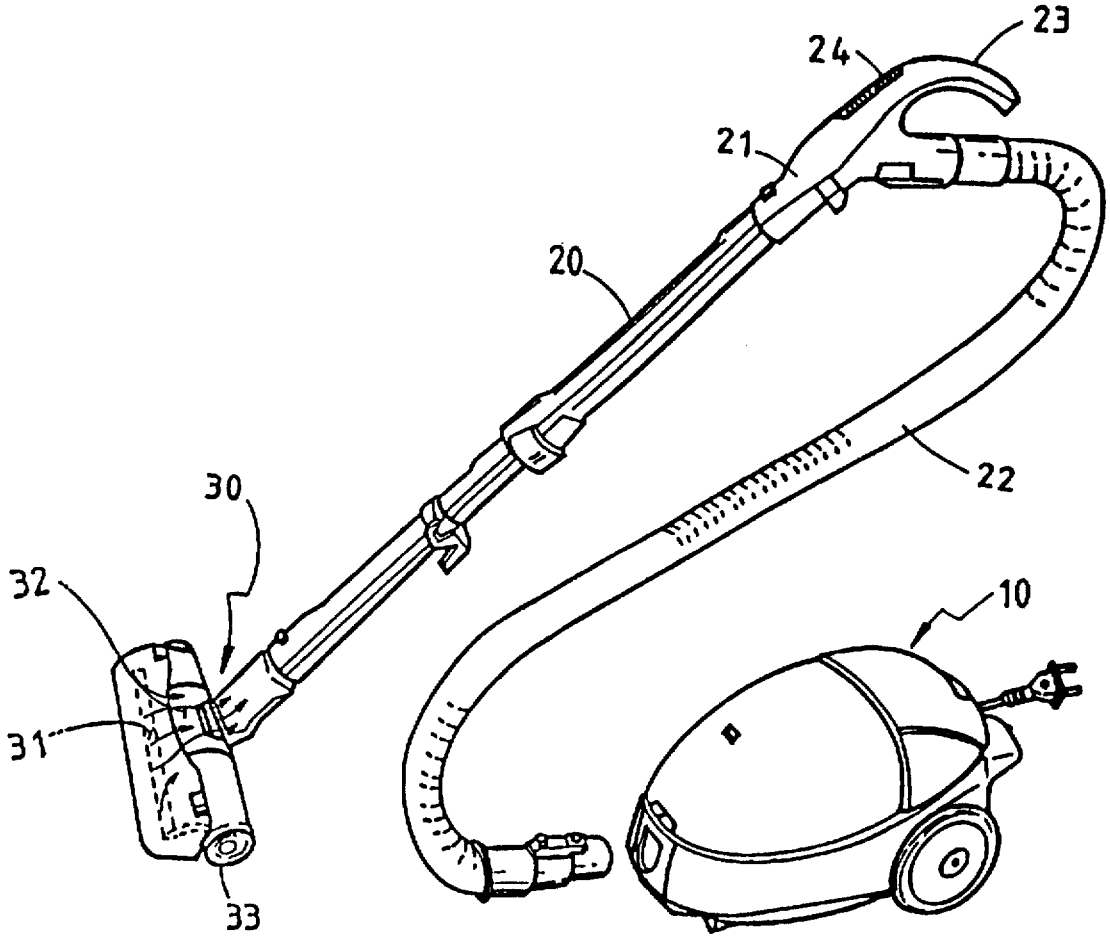
FIG 7 ( PRIOR ART )
FIG. 7 is a perspective view showing the overall construction of a conventional vacuum cleaner.

The technical scope of the present invention is not limited to the aforementioned structure; a lighting device 400 can alternatively be mounted on the cleaning attachment's 300 upper portion, as shown in FIGS. 5 and 6. More specifically, the lighting device 400 is installed on the upper portion of the cleaning attachment 300 so as to illuminate the area in front of the cleaning attachment 300. The lighting device 400 consists of a case 400*a* with a groove 400*b* and a bulb 420' installed in the groove 400*b*. The case 400*a* is detachably mounted on the upper portion of the cleaning attachment 300.

A slit 400*d* is formed lengthwise on the upper portion of the cleaning attachment 300. Locking pieces 400*c* are formed to extend downward from the lower portion of the case 400*a*, and have elasticity. The tip of each locking piece 400*c* securely fits into the slit 400*d* to detachably couple the case 400*a* to the cleaning attachment 300. The bulb 420' installed in the case 400*a* illuminates the surface to be cleaned, thus facilitating cleaning. As described above, the lighting device is installed on the cleaning attachment to illuminate a floor to be cleaned for the purpose of providing convenience to users. That is, a user can more easily locate dust particles on the floor to conduct efficient vacuum cleaning and save time.

What is claimed is:

1. A vacuum cleaner equipped with a main body and a cleaning attachment having a suction path so as to draw up dirt and dust by using a vacuum generated by said main body, comprising:

a lighting device mounted on said cleaning attachment to illuminate a surface to be cleaned, including a bulb for illumination set in a groove formed at a front part of said cleaning attachment and means for cooling said bulb, wherein the groove includes a plurality of air holes through which outside air flows into the groove; and a filter provided in the plurality of air holes to prevent dust and dirt from getting into the groove.

2. A vacuum cleaner as set forth in claim 1, wherein said lighting device is directly mounted on said cleaning attachment and further includes a case in which the bulb is installed to illuminate the surface.

3. A vacuum cleaner as set forth in claim 2, wherein the case includes a plurality of locking pieces that securely fit into a slit formed on said cleaning attachment so that said lighting device is connected to said cleaning attachment.

4. A vacuum cleaner as set forth in claim 2, further comprising a transparent window formed over said bulb on the groove.

5. A vacuum cleaner as set forth in claim 1, wherein said cooling means includes a plurality of heated-air emitting holes so that said groove is in communication with said suction path.

* * * * *